US012446667B2

(12) United States Patent
Hibayashi et al.

(10) Patent No.: US 12,446,667 B2
(45) Date of Patent: Oct. 21, 2025

(54) STRAP AND TIMEPIECE

(71) Applicant: SEIKO WATCH KABUSHIKI KAISHA, Tokyo (JP)

(72) Inventors: Yugo Hibayashi, Chiba (JP); Masanori Kawamura, Chiba (JP); Kento Ito, Chiba (JP); Yukio Kanemaki, Tokyo (JP); Takeshi Hiraoka, Tokyo (JP); Akihisa Edward Sugitani, Tokyo (JP); Yutaro Kamada, Tokyo (JP); Yukiyasu Yamada, Tokyo (JP)

(73) Assignee: SEIKO WATCH KABUSHIKI KAISHA (TRADING AS SEIKO WATCH CORPORATION), Tokyo (JP)

( * ) Notice: Subject to any disclaimer, the term of this patent is extended or adjusted under 35 U.S.C. 154(b) by 132 days.

(21) Appl. No.: 17/978,755

(22) Filed: Nov. 1, 2022

(65) Prior Publication Data

US 2023/0139816 A1 May 4, 2023

(30) Foreign Application Priority Data

Nov. 2, 2021 (JP) ..... 2021-179748

(51) Int. Cl.
*A44C 5/00* (2006.01)
*D04H 3/08* (2006.01)

(52) U.S. Cl.
CPC ..... *A44C 5/0053* (2013.01); *D04H 3/08* (2013.01)

(58) Field of Classification Search
CPC ..... A45C 5/0053
USPC ..... 224/164–179
See application file for complete search history.

(56) References Cited

U.S. PATENT DOCUMENTS 2,573,055 A * 10/1951 Pedersen ..... A44C 5/0053 63/3
4,110,139 A * 8/1978 Mashida ..... B29C 33/405 264/293
10,996,632 B2 * 5/2021 Rannoux ..... G04B 45/0076

FOREIGN PATENT DOCUMENTS

| | | | | |
|---|---|---|---|---|
| CN | 113547804 A | * | 10/2021 | |
| DE | 19652081 A1 | | 6/1997 | |
| DE | 19847710 A1 | * | 4/1999 | ..... A44C 5/0053 |
| DE | 19549540 B4 | * | 9/2005 | ..... A44C 5/0053 |
| EP | 3258533 A1 | * | 12/2017 | ..... A44C 5/0053 |
| GB | 2553364 A | | 3/2018 | |
| JP | H11-239506 A | | 9/1999 | |
| JP | 2007-263719 | | 10/2007 | |

OTHER PUBLICATIONS

Modernplastics.com, http://www.modernplastics.com/wp-content/uploads/2015/03/IAPD_plastics_intro5.pdf, visited via the Internet Archive on May 3, 2016 (Year: 2016).*

(Continued)

*Primary Examiner* — Scott T Mcnurlen
(74) *Attorney, Agent, or Firm* — Crowell & Moring LLP

(57) ABSTRACT

A strap is provided with a core having a core main body having a plurality of members including at least a member having flexibility is stacked, and a skin member surrounding the core. The core main body is formed of a variable performance member and a special member bonded to each other with thermocompression bonding to be stacked in a face-back direction of a timepiece. The variable performance member has flexibility and temperature dependency, and is formed including plastic.

11 Claims, 6 Drawing Sheets

(56) References Cited

OTHER PUBLICATIONS

Extended European Search Report in Europe Application No. 22204841.5, dated Mar. 7, 2023, 18 pages.
Office Action in EP Application No. 22 204 841.5, dated Feb. 19, 2024 (7 pages).
English Translation of Office Action in Japanese Application No. 2021-179748, dated Feb. 4, 2025 (5 pages).

* cited by examiner

STRAP AND TIMEPIECE

RELATED APPLICATIONS

This application claims priority to Japanese Patent Application No. 2021-179748, filed on Nov. 2, 2021, the entire content of which is incorporated herein by reference.

BACKGROUND OF THE INVENTION

1. Field of the Invention

The present invention relates to a strap and a timepiece.

2. Description of the Related Art

In the past, in the strap to be mounted on an arm such as a wristwatch, there are proposed a variety of technologies for improving the wear comfort around the arm.

For example, in JP-A-11-239506 (Document 1), there is disclosed a configuration of a wristwatch using a shape-memory alloy as a core of the strap. According to the technology described in Document 1, the strap is held in a C-shape due to the shape-memory alloy. Thus, it is assumed that it is possible to make detachment and attachment easy to obtain the high wear comfort.

Incidentally, in the strap mainly using synthetic resin, leather, or the like, since the bendability degrades as the thickness of the strap increases, there is a possibility that the wear comfort around the arm deteriorates. Further, there is a problem that by repeatedly bending the strap having a significant thickness, the strap becomes easy to deteriorate.

Therefore, the present invention has an object of providing a strap with which the deterioration can be prevented while improving the wear comfort, and a timepiece equipped with this strap.

SUMMARY OF THE INVENTION

In order to solve the problems described above, a strap according to an aspect of the present invention includes a core having a stacked structure in which a plurality of members including a member having flexibility is stacked, and a skin member configured to surround the core.

According to this configuration, it is possible to keep the bendability of the strap at a high level, and thus, it is possible to improve the wear comfort around the arm. In particular, when being used as a strap for a wristwatch, it is possible to increase the bendability even when increasing the thickness from a design requirement. Therefore, it is possible to enhance the general versatility.

Since the strap is formed of the stacked structure having the plurality of layers including at least the member having flexibility stacked on one another, it is possible to stack the members different in, for example, function and performance from each other in combination. Thus, by selecting members to be stacked in accordance with a variety of purposes besides the member having flexibility, it is possible to provide the core with high functionality. For example, by stacking a member for enhancing the shape keeping property or the adhesiveness, it is possible to prevent the deterioration of the strap due to the repeated bending of the strap.

Therefore, it is possible to provide the strap capable of preventing the deterioration while improving the wear comfort.

Further, in the strap described above, the stacked structure includes a first member which has flexibility, and is formed including plastic, and a second member thinner in thickness than the first member.

According to this configuration, the first member made of a plastic material having flexibility and the second member thinner than the first member are stacked on one another to thereby form the core. Since the first member is thicker than the second member, the core has flexibility as a main function. Thus, even when stacking a plurality of members, it is possible to obtain the high bendability as the core. Further, since the first member is formed of a plastic material, it is possible to prevent the hardness of the strap from increasing when increasing the thickness of the core compared to when forming the core from, for example, a metallic material. Therefore, even when the thickness of the core has increased, it is possible to keep the bendability at a high level to improve the wear comfort.

Further, in the strap described above, the stacked structure includes a first member which has flexibility, and is formed including plastic, and a second member different in material from the first member.

According to this configuration, the first member made of a plastic material having flexibility and the second member different in material from the first member are stacked on one another to thereby form the core. By combining the member having the flexibility and the member having a function other than the flexibility with each other as described above, it is possible to provide the core with a plurality of types of functionality. Therefore, even when the thickness has increased, it is possible to keep the bendability at a high level, and at the same time, effectively suppress the deterioration of the strap, and deformations and so on when using the strap.

Further, in the strap described above, the first member has a temperature dependency with which softness changes with temperature.

According to this configuration, for example, when mounting the strap on the arm, the strap is heated, and thus, the first member softens. Thus, the followability of the strap to the arm when mounted is enhanced, and thus, it is possible to improve the wear comfort. Further, even when the thickness of the strap has increased, since the strap is easy to bend, there is no need to forcibly bend the strap. Thus, it is possible to prevent the deterioration and so on of the strap due to, for example, an excessive force applied to the strap. Further, for example, after being detached, since the strap cools to have a lower temperature, the first member becomes difficult to deform. Thus, it is possible to prevent the deformation of the strap when not used (when not mounted on the arm), and thus, it is possible to prevent the strap from losing shape or deteriorating.

Further, in the strap described above, the first member is a plastic sheet having flexibility and temperature dependency, and the second member is nonwoven cloth.

According to this configuration, since such the first member is provided, it is possible to improve in particular the bendability and the wear comfort of the strap. Further, since the second member is provided, it is possible to realize the core which is easy to keep the shape, and which is excellent in adhesiveness and durability. Further, since the core can be formed without using a metallic material, even when the thickness of the strap has increased, it is possible to prevent the strap from unnecessarily hardening to thereby keep the bendability at a high level.

Further, in the strap described above, the stacked structure is formed by bonding the first member and the second member to each other with thermocompression bonding.

According to this configuration, it is possible to more easily stack the first member and the second member on one another compared to when using an adhesive. Further, since it is possible to bond the first member and the second member to each other after individually forming the first member and the second member, the shape freedom of the core is high, and it is possible to enhance productivity.

Further, in the strap described above, the core is formed of a core main body, and an auxiliary core disposed between the core main body and the skin member, and the stacked structure is the core main body.

Further, in the strap described above, the core is formed of a core main body, and an auxiliary core disposed between the core main body and the skin member, and the stacked structure is the auxiliary core.

A timepiece according to an aspect of the present invention includes the strap described above, and a timepiece main body to be coupled to the strap.

According to this configuration, it is possible to realize the configuration suitable when being used as a strap in particular for a wristwatch. Specifically, the bendability is enhanced, and thus, it is possible to improve the wear comfort of the user when mounting the strap around the arm. Further, it is possible to prevent the deterioration of the strap caused by repeating attachment to and detachment from the arm.

Therefore, it is possible to provide the timepiece equipped with the strap capable of preventing the deterioration while improving the wear comfort.

Further, in the timepiece described above, the core has an auxiliary core, and the auxiliary core is disposed in only a base end portion as a coupling portion to the timepiece main body in a longitudinal direction of the strap.

According to this configuration, the auxiliary core is disposed in only a part in the longitudinal direction of the strap. By disposing the auxiliary core in a part but not the whole of the strap as described above, it is possible to adapt the strap to a variety of designs and purposes. In particular, when disposing the auxiliary core in only the base end portion, it is possible to increase the thickness of the base end portion in the longitudinal direction of the strap. Thus, for example, when applying the strap to the wristwatch thick in the thickness of the timepiece main body, by forming the core so that the thickness gradually increases in the longitudinal direction from the central portion toward the base end portion, it is possible to express a luxury taste. Further, by adopting the configuration in which the auxiliary core is not disposed in the portion where buckle tongue holes and so on are formed, even when the core expands or contracts due to repeated use over the years, there is no chance of blocking the buckle tongue holes. Further, by thinning the thickness in an area from a tip portion to the central portion of the strap which is required to achieve a larger deformation amount, it is possible to make the area of the strap easy to bend to thereby enhance the usability for the user. Further, by using the auxiliary core described above, it is possible to keep the bendability at a high level even in the portion where the thickness has partially increased. Further, it is possible to change the thickness of the strap in accordance with the coupling structure between the strap and the timepiece main body. Therefore, it is possible to increase the general versatility of the timepiece.

DETAILED DESCRIPTION OF THE PREFERRED EMBODIMENTS

Some embodiments of the invention will hereinafter be described with reference to the drawings. It should be noted that in the following description, constituents having the same functions or similar functions are denoted by the same reference symbols. Further, the redundant descriptions of those constituents are omitted in some cases. In the following description, a side facing to an arm of the user when mounting a timepiece 10 on the arm is referred to as a reverse side, and an opposite side thereto is referred to as an obverse side, in some cases.

First Embodiment (Timepiece, Strap)

Figure 1:
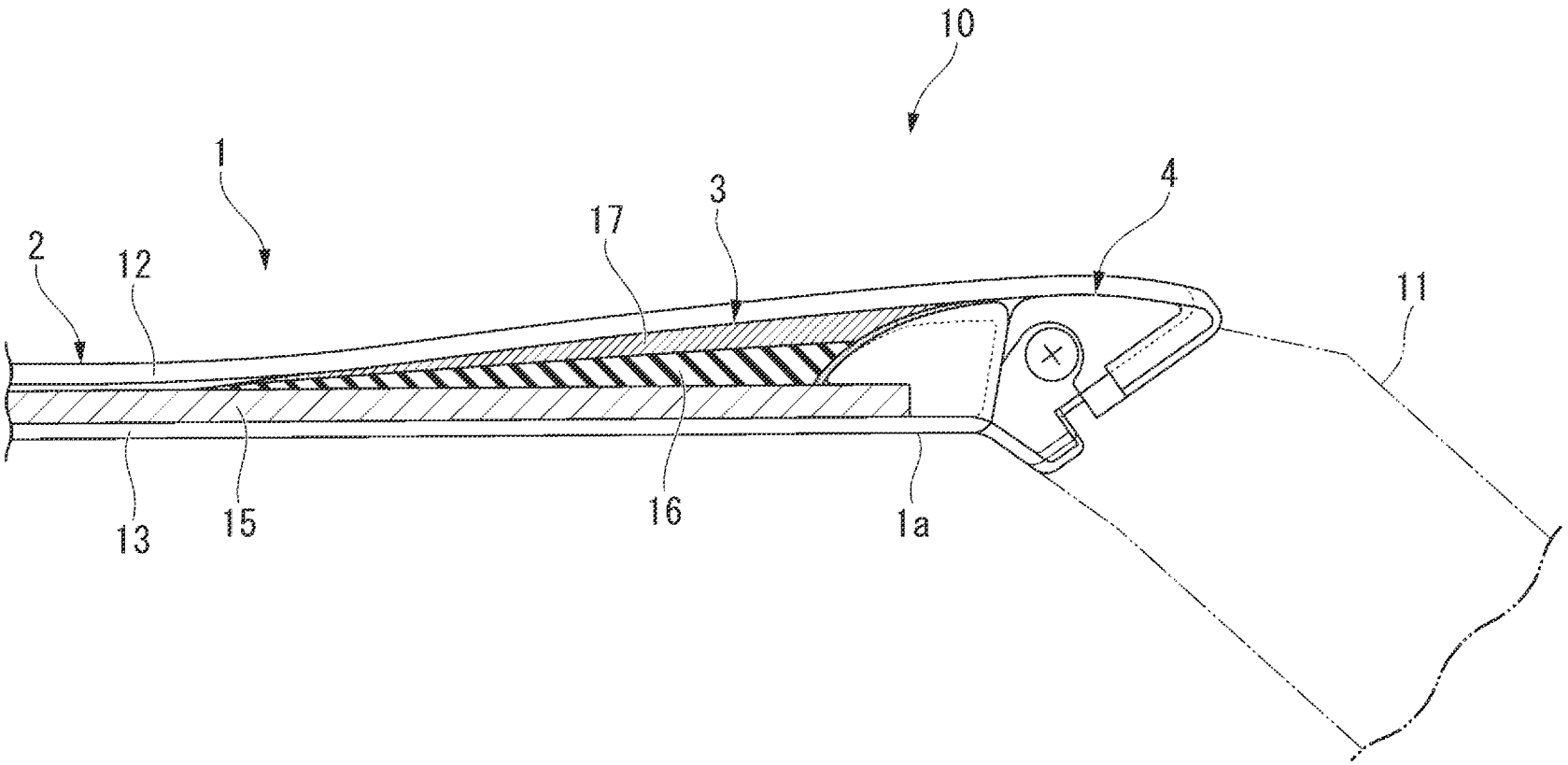
FIG. 1 is a cross-sectional view of a strap according to a first embodiment.
Figure 2:
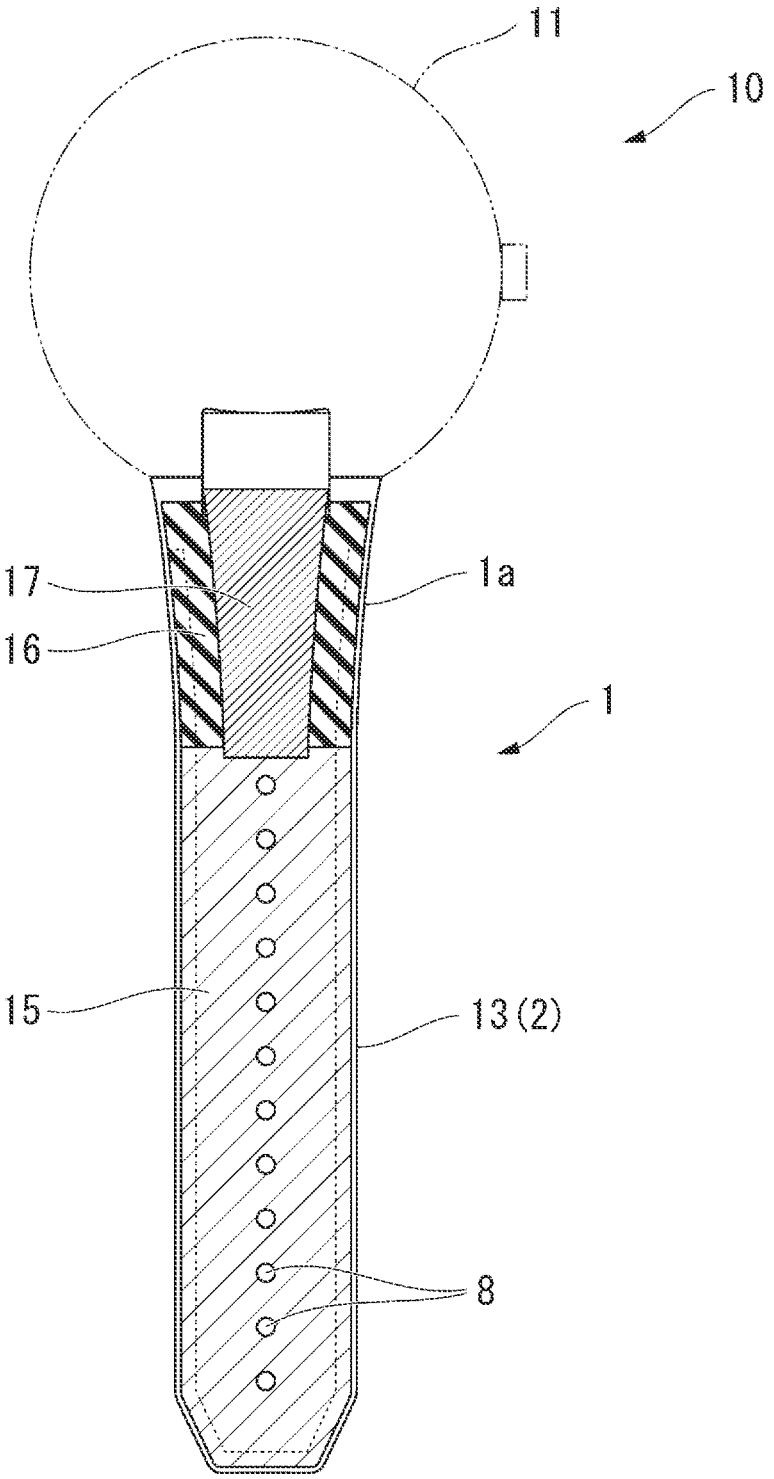
FIG. 2 is a top view of the strap according to the first embodiment.

FIG. 1 is a cross-sectional view of a strap 1 according to a first embodiment. FIG. 2 is a top view of the strap 1 according to the first embodiment. In FIG. 2, an illustration of a part (a face member 12) of a skin member 2 is omitted so that an inside of the strap 1 can be seen.

As shown in FIG. 1, the strap 1 is a strap for a timepiece (a wristwatch) 10 which is mounted by, for example, a user so as to be wound around an arm. The timepiece 10 is provided with a timepiece main body 11, and the strap 1 coupled to one end portion of the timepiece main body 11.

The strap 1 according to the present embodiment is a leather strap integrally formed using a leather material in, for example, at least a part of a surface. The strap 1 is provided with a buckle tongue (not shown), buckle tongue holes 8 (see FIG. 2), a clasp mechanism (not shown), and so on for coupling the strap 1 to the other strap. The strap 1 is provided with the skin member 2, a core 3, and an attachment member 4.

(Skin Member)

As shown in FIG. 1, the skin member 2 has the face member 12 and a back member 13. The face member 12 is a member disposed in a plane facing outward when mounting the timepiece 10 (the strap 1) on the arm of the user, and is a member to be a design face of the strap 1. The back member 13 is a member disposed in a plane facing toward the arm of the user when mounting the timepiece 10. As shown in FIG. 2, the face member 12 and the back member 13 are each formed to have a strip shape along a longitudinal direction of the strap 1, and are then bonded to each other in an outer circumferential portion with stitches, an adhesive, or the like. Thus, a space for inserting the core 3 described later is formed between the face member 12 and the back member 13. In other words, the skin member 2 is formed so as to surround the core 3.

(Core)

As shown in FIG. 1, the core 3 is disposed inside the skin member 2. The core 3 is disposed between the face member 12 and the back member 13. The core 3 is configured including at least a core main body 15. The core 3 can also have at least one auxiliary core 16, 17 as in the present embodiment in addition to the core main body 15. The core main body 15 is made separated from the auxiliary core 16, 17.

As shown in FIG. 1 and FIG. 2, the core main body 15 is disposed throughout almost entire length of the strap 1. The core main body 15 is formed to have a shape one-size smaller than the skin member 2 in a top view shown in FIG. 2. The core main body 15 has moderate flexibility in the level in which the strap 1 can be bent, and at the same time, has a function of increasing the strength of the strap 1.

The auxiliary cores 16, 17 are disposed closer to a face (the face member 12) of the strap 1 than the core main body 15. In the present embodiment, there is disposed a plurality of (two in the present embodiment) auxiliary cores 16, 17. A first auxiliary core 16 is disposed so as to have contact with a face-side surface of the core main body 15. A second auxiliary core 17 is disposed closer to the face than the first auxiliary core 16. In the following description, the first auxiliary core 16 and the second auxiliary core 17 are simply referred to as auxiliary cores 16, 17 in some cases when not discriminated from each other.

Figure 3:
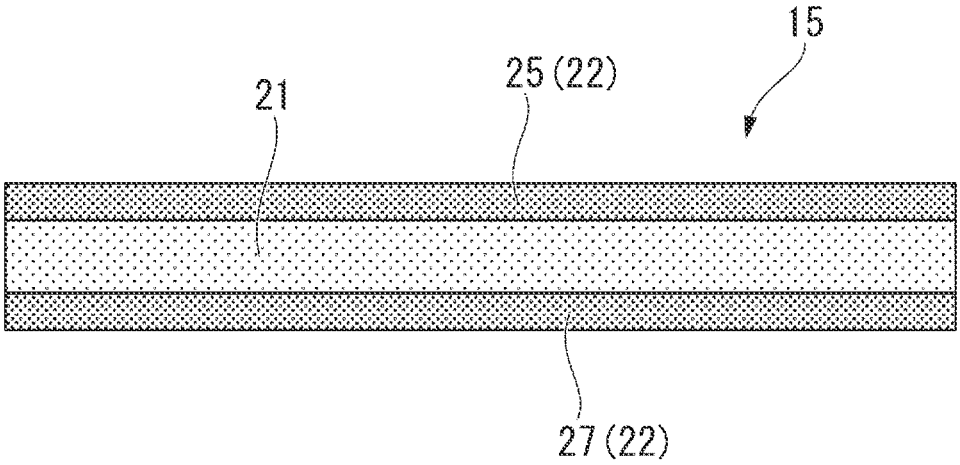
FIG. 3 is a schematic cross-sectional view of a core main body according to the first embodiment.

FIG. 3 is a schematic cross-sectional view of the core main body 15 according to the first embodiment. In FIG. 3, in order to make the explanation easy, the members stacked on one another are illustrated with the thickness thereof exaggerated. Therefore, the actual thicknesses of the respective members are not limited to the thicknesses shown in the drawings. It should be noted that although not shown in the drawings, the auxiliary cores 16, 17 are also configured similarly to the core main body 15 shown in FIG. 3.

As shown in FIG. 3, the core main body 15 is formed by stacking a plurality of members including at least a member having flexibility on one another in a face-back direction. Specifically, the core main body 15 has a variable performance member 21 (a first member in the appended claims) and a special member 22 (a second member in the appended claims).

The variable performance member 21 is a member having flexibility. The variable performance member 21 is formed of a material having at least elasticity, deformability (flexibility), and temperature dependency (sensitivity to temperature). Specifically, the variable performance member 21 is a plastic sheet (e.g., HUMOFIT (registered trademark)) having flexibility and temperature dependency. The variable performance member 21 can be what is obtained by bonding a plurality of plastic sheets to each other. The variable performance member 21 can be formed of a single plastic sheet. The sentence that the variable performance member 21 has temperature dependency means that softness of the variable performance member 21 changes with the temperature. The temperature at which the softness starts to change includes a temperature in the level of, for example, body temperature. Therefore, the variable performance member 21 has a function of becoming softer when the user mounts the strap 1 on the arm compared to when the strap 1 is not mounted.

The special member 22 is stacked on at least one surface of the variable performance member 21. In the present embodiment, the special member 22 is stacked on each of both surfaces of the variable performance member 21. To a face-side surface of the variable performance member 21, there is bonded a face-side special member 25. To a back-side surface of the variable performance member 21, there is bonded a back-side special member 27. Therefore, in the present embodiment, the core main body 15 is provided with a three-layer structure having the special member 22, the variable performance member 21, and the special member 22 stacked on one another in this order.

The special member 22 is formed thinner in thickness than the variable performance member 21. The special member 22 is formed of a material different from that of the variable performance member 21. Specifically, the face-side special member 25 and the back-side special member 27 are both nonwoven cloth. The special member 22 has a function of improving a shape keeping property, durability, and an adhesiveness with the skin member 2 in the core main body 15 and the auxiliary cores 16, 17 by being stacked on the variable performance member 21. The variable performance member 21 and the special member 22 are bonded to each other with thermocompression bonding or pressure bonding.

In the present embodiment, all of the core main body 15, the first auxiliary core 16, and the second auxiliary core 17 are stacked structures formed of equivalent materials. In other words, all of the core main body 15 and the auxiliary cores 16, 17 are formed by stacking the nonwoven cloth, the variable performance member 21, and the nonwoven cloth on one another in this order. It should be noted that the core main body 15, the first auxiliary core 16, and the second auxiliary core 17 are different in shape and thickness from each other as described later in detail.

As shown in FIG. 1 and FIG. 2, the auxiliary cores 16, 17 formed in such a manner are disposed in only a base end portion 1*a* as a coupling portion to the timepiece main body 11 in the longitudinal direction of the strap 1. As shown in FIG. 2, the first auxiliary core 16 is disposed in the base end portion 1*a* but is not disposed in a portion provided with the buckle tongue holes 8 in the longitudinal direction of the strap 1. A width dimension of the first auxiliary core 16 is substantially equivalent to a width dimension of the strap 1 (i.e., a width dimension of the skin member 2).

The second auxiliary core 17 is disposed in only the base end portion 1*a* of the strap 1 similarly to the first auxiliary core 16. The width dimension of the second auxiliary core 17 is smaller than the width dimension of the first auxiliary core 16. The second auxiliary core 17 is located in a central portion in the width direction of the strap 1.

Further, as shown in FIG. 1, each of the auxiliary cores 16, 17 is formed so that the thickness decreases in the longitudinal direction of the strap 1 from the base end portion 1*a* toward a central portion. Such auxiliary cores 16, 17 are formed by, for example, bonding the variable performance member 21 and the special members 22 to each other, then cutting the resultant into a desired shape, and then grinding down the resultant so that the thickness gradually changes.

Therefore, the auxiliary cores 16, 17 increase in thickness in the longitudinal direction of the strap 1 from the central portion toward the base end portion 1*a*. Further, the auxiliary cores 16, 17 increase in thickness in the width direction from both end portions toward the central portion in the base end portion 1*a*. Since the thickness of the skin member 2 and the core main body 15 is made substantially constant, by adopting the auxiliary cores 16, 17 described above as the core 3, the whole of the strap 1 is formed to generate the variation in thickness described above.

(Attachment Member)

The attachment member 4 is disposed between the rest of the strap 1 and the timepiece main body 11. The attachment member 4 couples a strap main body constituted by the skin member 2 and the core 3 described above, and the timepiece main body 11 to each other.

Modified Example of First Embodiment

Figure 4:
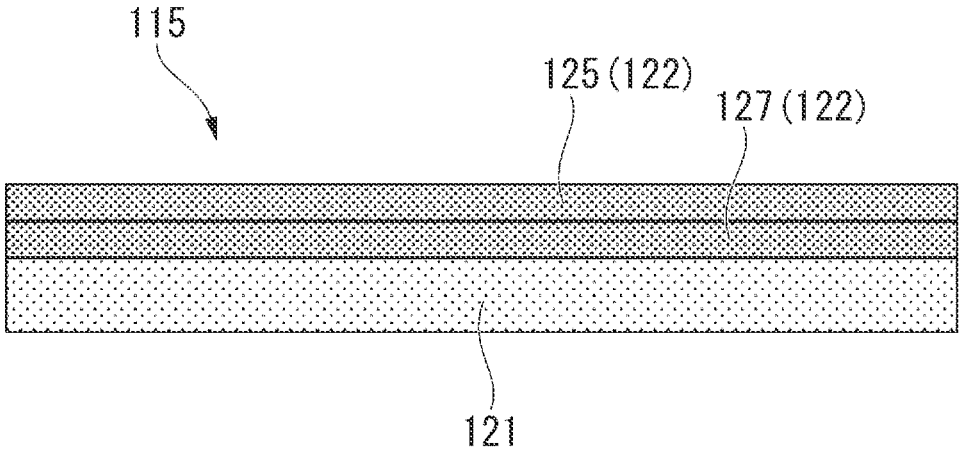
FIG. 4 is a schematic cross-sectional view of a core main body according to a modified example of the first embodiment.

FIG. 4 is a schematic cross-sectional view of a core main body 115 according to a modified example of the first embodiment. It should be noted that although not shown in the drawings, the first auxiliary core and the second auxiliary core can also be configured similarly to the core main body 115 shown in FIG. 4.

In the modified example, the core main body 115 has a variable performance member 121 and a special member 122 stacked on one side of the variable performance member 121.

The special member 122 has a back-side special member 127 and a face-side special member 125. The back-side special member 127 is bonded to the face-side surface of the variable performance member 121. The face-side special member 125 is disposed at the face side of the back-side special member 127. The face-side special member 125 is bonded to the face-side surface of the back-side special member 127. Therefore, in the present modified example, the core main body 115 is provided with a three-layer structure having the special member 122, the special member 122, and the variable performance member 121 stacked on one another in this order.

It should be noted that in the present modified example, the core main body 115 is provided with the structure having the special member 122, the special member 122, and the variable performance member 121 stacked on one another in this order as shown in FIG. 4, but this is not a limitation. It is also possible to adopt a configuration in which any one or two of the core main body 115, the first auxiliary core 16, and the second auxiliary core 17 be provided with the structure shown in FIG. 4, and the rest thereof be provided with the structure having the special member 22, the variable performance member 21, and the special member 22 stacked on one another in this order as shown in FIG. 3.

(Functions, Advantages)

Then, the functions and advantages of the strap 1 and the timepiece 10 described above will be described.

According to the strap 1 in the present embodiment, the strap 1 is provided with the core 3 formed of the stacked structure including at least the member having flexibility, and the skin member 2 surrounding the core 3. Therefore, it is possible to keep the bendability of the strap 1 at a high level, and thus, it is possible to improve the wear comfort around the arm. In particular, when being used as the strap 1 for the wristwatch 10, it is possible to increase the bendability even when increasing the thickness from a design requirement. Therefore, it is possible to enhance the general versatility.

In the strap 1, since the core main body 15 and the auxiliary cores 16, 17 are each formed of the stacked structure having the plurality of layers including at least the member having flexibility stacked on one another, it is possible to stack the members different in, for example, function and performance from each other in combination. Thus, by selecting members to be stacked in accordance with a variety of purposes besides the member having flexibility, it is possible to provide the core 3 with high functionality. For example, by stacking a member for enhancing the shape keeping property or the adhesiveness, it is possible to prevent the deterioration of the strap 1 due to the repeated bending of the strap 1.

Therefore, it is possible to provide the strap 1 capable of preventing the deterioration while improving the wear comfort.

The core main body 15 and the auxiliary cores 16, 17 each have the variable performance member 21 (the first member in the appended claims) and the special member 22 (the second member in the appended claims) thinner in thickness than the variable performance member 21. According to this configuration, the core main body 15 and the auxiliary cores 16, 17 are each formed by stacking the variable performance member 21 as a plastic material having flexibility and the special member 22 thinner than the variable performance member 21 on one another. Since the variable performance member 21 is thicker than the special member 22, the core main body 15 and the auxiliary cores 16, 17 have the flexibility as a main function. Thus, even when stacking a plurality of members, it is possible to obtain the high bendability as the core 3. Further, since the variable performance member 21 is formed of the plastic material, it is possible to prevent the hardness of the strap 1 from increasing when increasing the thickness of the core 3 compared to when forming the core 3 from, for example, a metallic material. Therefore, even when the thickness of the core 3 has increased, it is possible to keep the bendability at a high level to improve the wear comfort.

The core main body 15 and the auxiliary cores 16, 17 each have the variable performance member 21 and the special member 22 different in material from the variable performance member 21. According to this configuration, the core main body 15 and the auxiliary cores 16, 17 are each formed by stacking the variable performance member 21 as a plastic material having flexibility and the special member 22 different in material from the variable performance member 21 on one another. By combining the member having the flexibility and the member having a function other than the flexibility with each other as described above, it is possible to provide the core 3 with a plurality of types of functionality. Therefore, even when the thickness has increased, it is possible to keep the bendability at a high level, and at the same time, effectively suppress the deterioration of the strap 1, and deformations and so on when using the strap 1.

The variable performance member 21 has the temperature dependency that the softness changes with the temperature. Therefore, for example, when mounting the strap 1 on the arm, the strap 1 is heated, and thus, the variable performance member 21 softens. Thus, the followability of the strap 1 to the arm when mounted is enhanced, and thus, it is possible to improve the wear comfort. Further, even when the thickness of the strap 1 has increased, since the strap 1 is easy to bend, there is no need to forcibly bend the strap 1. Thus, it is possible to prevent the deterioration and so on of the strap 1 due to, for example, an excessive force applied to the strap 1. Further, for example, after being detached, since the strap 1 cools to have a lower temperature, the variable performance member 21 becomes difficult to deform. Thus, it is possible to prevent the deformation of the strap 1 when not used (when not mounted on the arm), and thus, it is possible to prevent the strap 1 from losing shape or deteriorating.

The variable performance member 21 is a plastic sheet having flexibility and temperature dependency, and the special member 22 is nonwoven cloth. Since such a variable performance member 21 is provided, it is possible to improve in particular the bendability and the wear comfort of the strap 1. Further, since the special member 22 is provided, it is possible to realize the core 3 which is easy to keep the shape, and which is excellent in adhesiveness and durability. Further, since the core 3 can be formed without using a metallic material, even when the thickness of the strap 1 has increased, it is possible to prevent the strap 1 from unnecessarily hardening to thereby keep the bendability at a high level.

The core main body 15 and the auxiliary cores 16, 17 are formed by bonding the variable performance member 21 and the special member 22 to each other with the thermocompression bonding. Thus, it is possible to more easily stack the variable performance member 21 and the special member 22 on one another compared to when using the adhesive. Further, since it is possible to bond the variable performance member 21 and the special member 22 to each other after individually forming the variable performance member 21 and the special member 22, the shape freedom of the core 3 is high, and it is possible to enhance productivity.

According to the timepiece 10 in the present embodiment, timepiece 10 includes the strap 1 described above and the timepiece main body 11 to be coupled to the strap 1. Therefore, it is possible to realize the configuration suitable when being used as the strap 1 in particular for the wristwatch 10. Specifically, the bendability is enhanced, and thus, it is possible to improve the wear comfort of the user when mounting the strap 1 around the arm. Further, it is possible to prevent the deterioration of the strap 1 caused by repeating attachment to and detachment from the arm.

Therefore, it is possible to provide the timepiece 10 equipped with the strap 1 capable of preventing the deterioration while improving the wear comfort.

The auxiliary cores 16, 17 are disposed in only the base end portion 1*a* as the coupling portion to the timepiece main body 11 in the longitudinal direction of the strap 1. The auxiliary cores 16, 17 are disposed in only a part in the longitudinal direction of the strap 1. By disposing the auxiliary cores 16, 17 in a part but not the whole of the strap 1 as described above, it is possible to adapt the strap 1 to a variety of designs and purposes. In particular, when disposing the auxiliary cores 16, 17 in only the base end portion 1*a*, it is possible to increase the thickness of the base end portion 1*a* in the longitudinal direction of the strap 1. Thus, for example, when applying the strap 1 to the wristwatch 10 thick in the thickness of the timepiece main body 11, by forming the core 3 so that the thickness gradually increases in the longitudinal direction from the central portion toward the base end portion 1*a*, it is possible to express a luxury taste. Further, by adopting the configuration in which the auxiliary cores 16, 17 are not disposed in the portion where the buckle tongue holes 8 and so on are formed, even when the core 3 expands or contracts due to repeated use over the years, there is no chance of blocking the buckle tongue holes 8. Further, by thinning the thickness in an area from a tip portion to the central portion of the strap 1 which is required to achieve a larger deformation amount, it is possible to make the area of the strap 1 easy to bend to thereby enhance the usability for the user. Further, by using the auxiliary cores 16, 17 described above, it is possible to keep the bendability at a high level even in the portion where the thickness has partially increased. Further, it is possible to change the thickness of the strap 1 in accordance with the coupling structure between the strap 1 and the timepiece main body 11. Therefore, it is possible to increase the general versatility of the timepiece 10.

Second Embodiment

Figure 5:
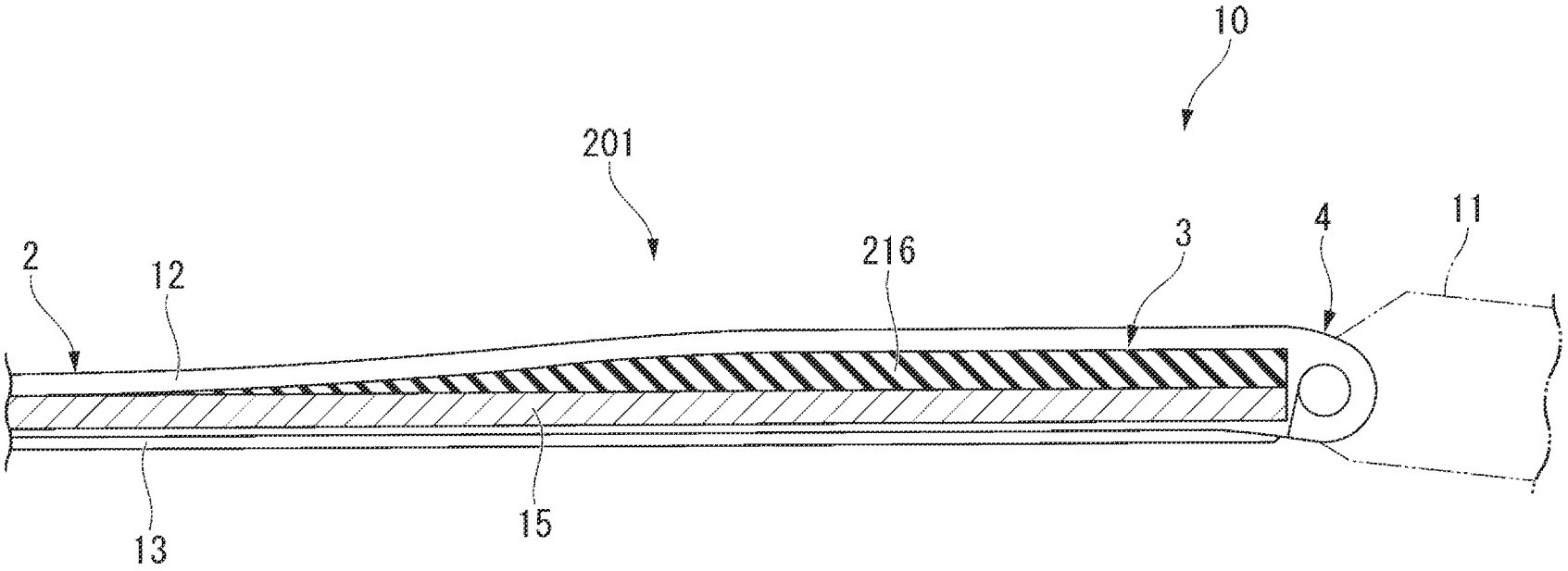
FIG. 5 is a cross-sectional view of a strap according to a second embodiment.
Figure 6:
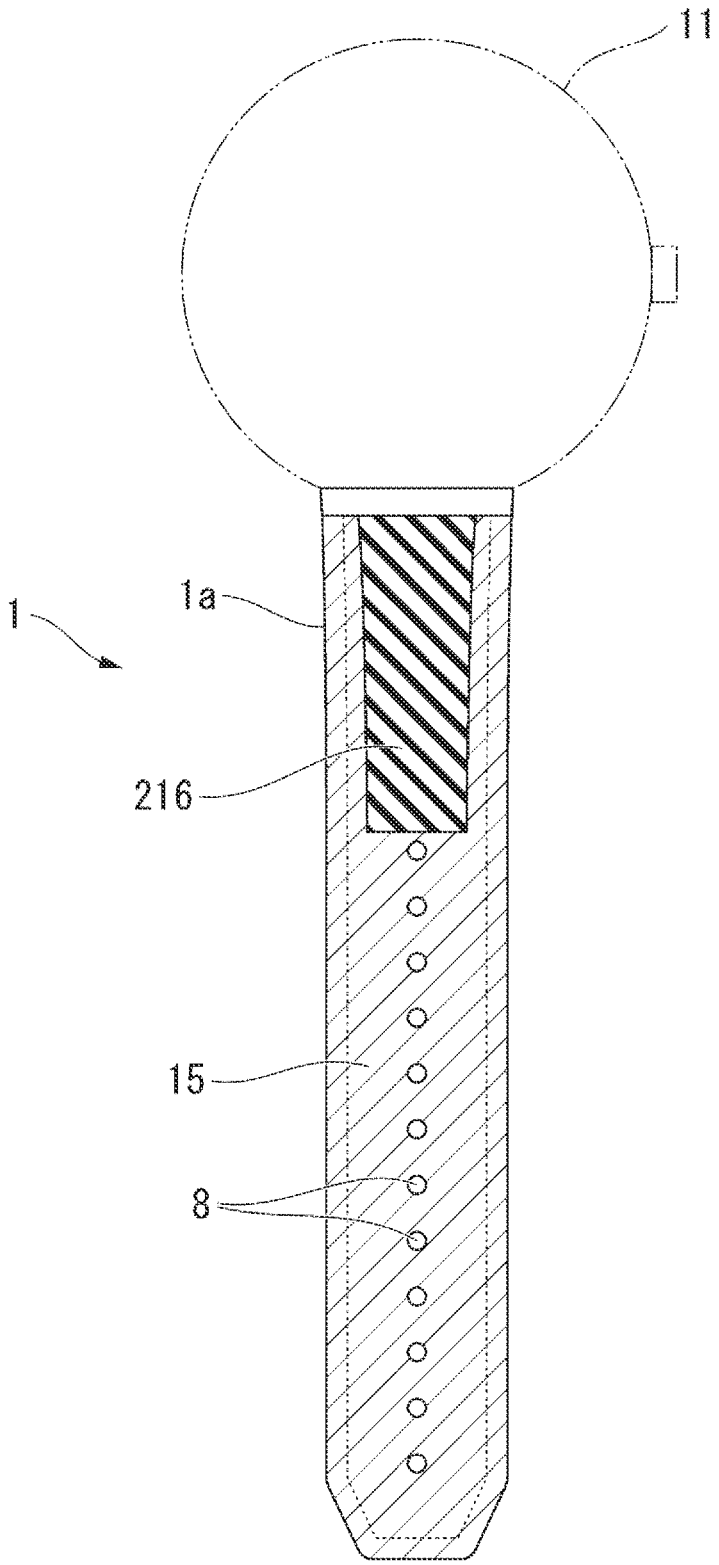
FIG. 6 is a top view of the strap according to the second embodiment.
Figure 7:
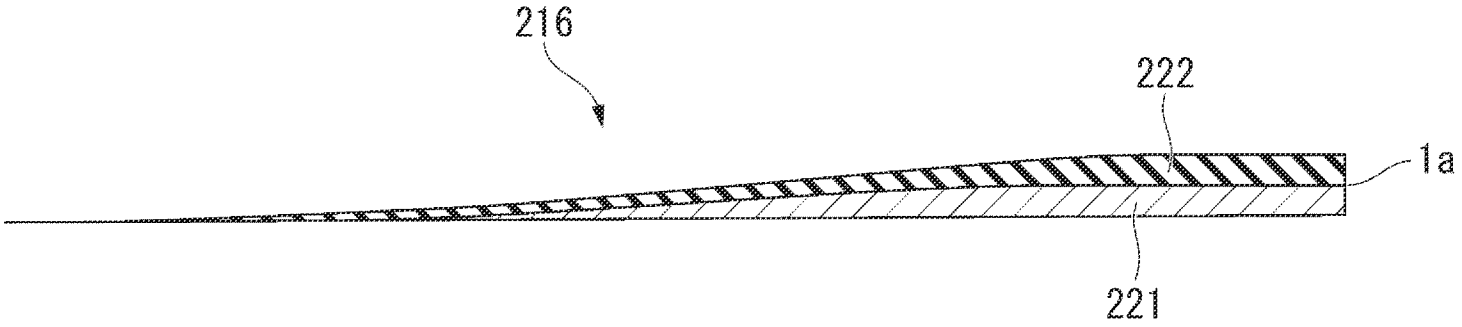
FIG. 7 is a schematic cross-sectional view of an auxiliary core according to the second embodiment.

FIG. 5 is a cross-sectional view of a strap 201 according to a second embodiment. FIG. 6 is a top view of the strap 201 according to the second embodiment. FIG. 7 is a schematic cross-sectional view of an auxiliary core 216 according to the second embodiment. In FIG. 6, similarly to FIG. 2, an illustration of a part (the face member 12) of the skin member 2 is omitted so that an inside of the strap 201 can be seen.

The second embodiment is different from the first embodiment described above in the point that the core 3 has the single auxiliary core 216, and the point that a special member 222 is disposed on only a single surface of the variable performance member 221.

As shown in FIG. 5 and FIG. 6, the core 3 of the strap 201 according to the second embodiment has the core main body 15 and the single auxiliary core 216. The configuration of the core main body 15 is equivalent to the configuration of the core main body 15 in the first embodiment, and therefore, the description thereof will be omitted.

In the second embodiment, there is disposed just one auxiliary core 216. The auxiliary core 216 is disposed at the face side of the core main body 15. The auxiliary core 216 is disposed so as to have contact with the face-side surface of the core main body 15. The auxiliary core 216 is disposed in the base end portion 1*a* as the coupling portion to the timepiece main body 11 in the longitudinal direction of the strap 201. The auxiliary core 216 is disposed in the base end portion 1*a* but is not disposed in the portion provided with the buckle tongue holes 8 in the longitudinal direction of the strap 201. A width dimension of the auxiliary core 216 is smaller than a width dimension of the strap 201. The auxiliary core 216 is disposed in a central portion in the width direction of the strap 201.

As shown in FIG. 5 and FIG. 7, the auxiliary core 216 is formed so that the thickness decreases in the longitudinal direction of the strap 201 from the base end portion 1*a* toward a central portion. Therefore, the strap 201 formed so that the thickness increases in the longitudinal direction from the central portion toward the base end portion 1*a*. Further, the strap 201 is formed so that the thickness in the central portion becomes thicker compared to both end portions in the width direction in the base end portion 1*a*.

As shown in FIG. 7, the auxiliary core 216 in the second embodiment has a variable performance member 221 and a single special member 222. The materials of the variable performance member 221 and the special member 222 are substantially the same as in the first embodiment. The variable performance member 221 is formed so that the thickness decreases in the longitudinal direction of the strap 201 from the base end portion 1*a* toward the central portion. The special member 222 is bonded to a face-side surface of the variable performance member 221.

According to the strap 201 in the second embodiment, the thickness of the whole of the strap 201 including the base end portion 1*a* is formed thinly compared to the first embodiment. Therefore, the strap 201 can suitably be used as a thinner strap 201. Further, since the core 3 has the auxiliary core 216, it is possible to exert substantially the same functions and advantages as in the first embodiment.

It should be noted that the scope of the invention is not limited to the embodiments described above, but a variety of modifications can be applied within the scope or the spirit of the invention.

For example, in the embodiments described above, there are described the examples in which the strap 1, 201 is a leather strap, but this is not a limitation. It is possible for the strap 1, 201 to have a structure integrally formed of a member other than leather such as a nylon strap or a silicon strap. Further, the invention can be applied to any types of straps.

In the embodiments described above, there are described the examples in which the core 3 has the single auxiliary core 216 or the two auxiliary cores 16, 17, but this is not a limitation. It is possible for the core 3 to have three or more auxiliary cores. When the core 3 has a plurality of auxiliary cores, the material, the thickness, the shape, the order and the number of the layers to be stacked, and so on of the variable performance member 21 and the special member 22 can be different between the auxiliary cores.

The special member 22 can be formed of a material such as synthetic leather or paper besides the nonwoven cloth.

The variable performance member 21 and the special member 22 can be bonded to each other with an adhesive or the like. Further, it is not required to bond the variable performance member 21 and the special member 22 to each other. It should be noted that the configuration of the present embodiment in which the variable performance member 21 and the special member 22 are bonded to each other with the thermocompression bonding is superior in the point that it is possible to further prevent the core main body 15 and the auxiliary cores 16, 17 from losing shapes, and it is possible to make the bonding work easier.

Besides the above, it is arbitrarily possible to replace the constituents in the embodiments described above with known constituents within the scope or the spirit of the present invention, and it is also possible to arbitrarily combine the embodiments described above with each other.

What is claimed is:

1. A strap, comprising:

a core having a first stacked structure, a second stacked structure formed separately from the first stacked structure, and a third stacked structure formed separately from the first stacked structure and the second stacked structure, each of the first stacked structure, the second stacked structure, and the third stacked structure in which a plurality of members comprising a member having flexibility is stacked; and a skin member configured to surround the core, wherein the core comprises a core main body, and a first auxiliary core and a second auxiliary core disposed between the core main body and the skin member, a width dimension of the second auxiliary core smaller than a width dimension of the first auxiliary core, wherein the core main body comprises the first stacked structure, and wherein the first auxiliary core comprises the second stacked structure, and wherein the second auxiliary core comprises the third stacked structure.

2. The strap according to claim 1, wherein the first stacked structure comprises a first member which has flexibility, and is formed including plastic, and a second member thinner in thickness than the first member.

3. The strap according to claim 2, wherein the first member has temperature dependency that softness changes with temperature.

4. The strap according to claim 2, wherein the first member is a plastic sheet having flexibility and temperature dependency, and the second member is nonwoven cloth.

5. The strap according to claim 2, wherein the first stacked structure is formed by bonding the first member and the second member to each other with thermocompression bonding.

6. The strap according to claim 1, wherein the first stacked structure comprises a first member which has flexibility, and is formed including plastic, and a second member different in material from the first member.

7. The strap according to claim 6, wherein the first member has temperature dependency that softness changes with temperature.

8. The strap according to claim 6, wherein the first member is a plastic sheet having flexibility and temperature dependency, and the second member is nonwoven cloth.

9. The strap according to claim 6, wherein the first stacked structure is formed by bonding the first member and the second member to each other with thermocompression bonding.

10. A timepiece comprising:

the strap according to claim 1; and a timepiece main body to be coupled to the strap.

11. The timepiece according to claim 10, wherein the first auxiliary core and the second auxiliary core are disposed in only a base end portion as a coupling portion to the timepiece main body in a longitudinal direction of the strap.

* * * * *